US009446927B2

(12) United States Patent
Schaede

(10) Patent No.: US 9,446,927 B2
(45) Date of Patent: Sep. 20, 2016

(54) METHOD AND SYSTEM FOR PROCESSING PRINTED SHEETS, ESPECIALLY SHEETS OF PRINTED SECURITIES, INTO INDIVIDUAL DOCUMENTS

(75) Inventor: Johannes Georg Schaede, Würzburg (DE)

(73) Assignee: KBA-NOTASYS SA, Lausanne (CH)

( * ) Notice: Subject to any disclaimer, the term of this patent is extended or adjusted under 35 U.S.C. 154(b) by 917 days.

(21) Appl. No.: 13/130,263

(22) PCT Filed: Nov. 19, 2009

(86) PCT No.: PCT/IB2009/055164

§ 371 (c)(1),
(2), (4) Date: Jul. 28, 2011

(87) PCT Pub. No.: WO2010/058359

PCT Pub. Date: May 27, 2010

(65) Prior Publication Data

US 2011/0299722 A1 Dec. 8, 2011

(30) Foreign Application Priority Data

Nov. 21, 2008 (EP) ..... 08169609

(51) Int. Cl.
*B65B 35/50* (2006.01)
*B65H 35/02* (2006.01)
*B65H 35/04* (2006.01)

(52) U.S. Cl.
CPC ..... *B65H 35/02* (2013.01); *B65H 35/04* (2013.01); *B65H 2701/1912* (2013.01)

(58) Field of Classification Search
CPC . B42D 25/00; B42D 25/475; B42D 2035/08
USPC ..... 53/399, 435, 447, 513, 520, 540, 582; 83/614, 588, 378, 563, 27, 36, 91, 93, 83/698.21, 468.5, 74, 365, 76.1
See application file for complete search history.

(56) References Cited

U.S. PATENT DOCUMENTS 3,412,993 A 11/1968 Giori
3,461,581 A * 8/1969 Hoffmann ..... 283/107

(Continued)

FOREIGN PATENT DOCUMENTS

DE 195 15 705 10/1996
EP 0 598 679 5/1994

(Continued)

*Primary Examiner* — Gloria R Weeks
*Assistant Examiner* — Eyamindae Jallow
(74) *Attorney, Agent, or Firm* — Seager, Tufte & Wickhem LLP

(57) ABSTRACT

There is described method of processing printed sheets (100), especially sheets of printed securities, into individual documents (150), such as banknotes, each printed sheet (100) comprising an array of imprints arranged in a matrix of rows and columns. The method comprises the following steps : (i) pre-processing the printed sheets (100) by partly slitting each printed sheet (100) row-wise or column-wise to form slits (110) between adjacent rows or adjacent columns of imprints, slitting being performed in such a manner that the adjacent rows or adjacent columns of imprints are still attached to one another at edges of each thus pre-processed printed sheet (100'); (ii) stacking the pre-processed printed sheets (100') so as to form sheet stacks (121, 122) comprising a predetermined number of pre-processed printed sheets (100') stacked one upon the other; and (iii) processing the sheet stacks (121, 122) by cutting each sheet stack (121, 122) column-wise or row-wise along cutting lines (115) between adjacent columns or rows of imprints, cutting being performed along a direction perpendicular to the direction of the slits (110) and in such a manner that individual documents (150) are produced as a result. Also described is a system for carrying out this method.

18 Claims, 11 Drawing Sheets

(56) References Cited

U.S. PATENT DOCUMENTS

| | | | | |
|---|---|---|---|---|
| 3,939,621 | A | 2/1976 | Giori | |
| 4,045,944 | A | 9/1977 | Giori | |
| 4,299,325 | A | 11/1981 | Quinton et al. | |
| 4,453,707 | A | 6/1984 | Kühfuss | |
| 4,558,557 | A | 12/1985 | Kuehfuss | |
| 4,915,371 | A | 4/1990 | Quinton | |
| 4,939,888 | A * | 7/1990 | Katz et al. | 53/411 |
| 5,430,992 | A * | 7/1995 | Olson | 53/399 |
| 5,626,005 | A | 5/1997 | Klingelhoefer | |
| 6,260,456 | B1 | 7/2001 | Schaede | |
| 6,729,216 | B2 | 5/2004 | Schaede | |
| 6,769,718 | B1 * | 8/2004 | Warther et al. | 283/61 |
| 7,029,547 | B2 * | 4/2006 | Biller | 156/219 |
| 7,096,784 | B2 | 8/2006 | Giori et al. | |
| 7,216,583 | B2 | 5/2007 | Schaede | |
| 7,257,937 | B2 | 8/2007 | Nakagiri et al. | |
| 7,273,008 | B2 | 9/2007 | Giori et al. | |
| 7,384,003 | B1 * | 6/2008 | Boyer et al. | 235/494 |
| 7,429,036 | B2 * | 9/2008 | McGrane | 270/1.01 |
| 7,571,861 | B2 * | 8/2009 | Eke et al. | 235/487 |
| 7,631,857 | B2 * | 12/2009 | Hunkeler et al. | 270/5.03 |
| 7,648,063 | B2 * | 1/2010 | Priya et al. | 235/380 |
| 7,869,623 | B2 | 1/2011 | Schaede | |
| 8,230,665 | B2 * | 7/2012 | Pugh et al. | 53/447 |
| 2002/0005026 | A1 * | 1/2002 | Neri | 53/399 |
| 2002/0073651 | A1 * | 6/2002 | Muller | 53/399 |
| 2002/0124697 | A1 | 9/2002 | Schaede | |
| 2003/0131702 | A1 | 7/2003 | Sauer et al. | |
| 2004/0026851 | A1 | 2/2004 | Schaede et al. | |
| 2004/0177735 | A1 | 9/2004 | Nakagiri et al. | |
| 2005/0028922 | A1 * | 2/2005 | Biller | 156/219 |
| 2005/0067497 | A1 * | 3/2005 | Jones et al. | 235/492 |
| 2005/0223922 | A1 | 10/2005 | Giori et al. | |
| 2006/0162585 | A1 | 7/2006 | Schaede | |
| 2006/0208412 | A1 | 9/2006 | Reinhard et al. | |
| 2006/0213384 | A1 | 9/2006 | Reinhard et al. | |
| 2006/0249040 | A1 | 11/2006 | Giori et al. | |
| 2007/0204572 | A1 | 9/2007 | Nakagiri et al. | |
| 2007/0274567 | A1 | 11/2007 | Schaede | |
| 2009/0003656 | A1 | 1/2009 | Reinhard et al. | |
| 2009/0243181 | A1 | 10/2009 | Sauer | |
| 2010/0127490 | A1 * | 5/2010 | Novack et al. | 283/71 |
| 2010/0139463 | A1 | 6/2010 | Schaede | |
| 2011/0036221 | A1 * | 2/2011 | Saunders | 83/13 |
| 2012/0175864 | A1 * | 7/2012 | Kennedy | 281/38 |
| 2013/0180218 | A1 * | 7/2013 | Sakoguchi et al. | 53/540 |
| 2013/0192111 | A1 * | 8/2013 | Kennedy | 40/638 |

FOREIGN PATENT DOCUMENTS

| | | | |
|---|---|---|---|
| EP | 0 656 309 | | 6/1995 |
| EP | 1452473 | A2 | 9/2004 |
| EP | 1 607 355 | | 12/2005 |
| RU | 2199482 | C2 | 2/2003 |
| SU | 740165 | A3 | 6/1980 |
| WO | 01/49464 | | 7/2001 |
| WO | 01/85457 | | 11/2001 |
| WO | 01/85586 | | 11/2001 |
| WO | 2004/016433 | | 2/2004 |
| WO | 2005/008605 | | 1/2005 |
| WO | 2005/008606 | | 1/2005 |
| WO | 2005/104045 | | 11/2005 |
| WO | 2008/010125 | | 1/2008 |
| WO | 2008/126005 | | 10/2008 |

* cited by examiner

METHOD AND SYSTEM FOR PROCESSING PRINTED SHEETS, ESPECIALLY SHEETS OF PRINTED SECURITIES, INTO INDIVIDUAL DOCUMENTS

TECHNICAL FIELD

The present invention generally relates to a method and system for processing printed sheets, especially sheets of printed securities, into individual documents such as banknotes.

BACKGROUND OF THE INVENTION

Banknotes and like securities are commonly produced by processing successive individual sheets or portions of a continuous web each carrying a plurality of individual imprints arranged in a matrix of rows and columns, which sheets or web portions are subjected to various printing and processing steps before being cut into individual documents (or notes). Amongst the printing and processing steps typically carried out during the production of banknotes are offset printing, intaglio printing, silk-screen printing, foil application, letterpress printing and varnishing. Other processing steps might be carried out during the production such as window cutting, ink-jet marking, laser marking, micro-perforation, etc. Once fully printed, the sheets or successive portions of continuous web have to be subjected to a so-called finishing process whereby the sheets or successive portions of continuous web are processed (i.e. cut and assembled) to form individual documents that are typically bundled and packed.

FIG. 1 summarizes a typical process of producing securities such as banknotes. The production process illustrated in FIG. 1 is advantageous in that it enables maximisation of the production efficiency by reducing waste to a minimum and enables the production of bundles and packs of bundles with uninterrupted numbering sequence.

Step S1 in FIG. 1 denotes the various printing phases which are typically carried out during the production of securities. As mentioned, these various printing phases include in particular an offset printing phase whereby sheets are printed on one or both sides with an offset background, an intaglio printing phase whereby the sheets are printed on one or both sides with intaglio features (i.e. embossed features which are readily recognizable by touch), a silk-screen printing phase whereby the sheets are printed on one or both sides with silk-screen features, such as features made of optically variable ink (OVI), and/or a foil/patch application phase whereby foils or patches, in particular so-called optically variable devices (OVD), holograms, or similar optically diffractive structures, are applied onto one or both sides of the sheets, etc.

As a result of the various printing phases of step S1, successive printed sheets 100 are produced. While quality control checks are usually performed at various stages during the production of the securities, a final quality check is typically carried out on the full sheets after these have completely been printed. This full-sheet quality inspection is schematised by step S2 in FIG. 1. Three categories of sheets in terms of quality requirements are generated as a result of this full-sheet quality inspection, namely (i) good sheets (i.e. sheets carrying securities which are all regarded to be satisfactory from the point of view of the quality requirements), (ii) partly defective sheets (i.e. sheets carrying both securities which are satisfactory from the point of view of the quality requirements and securities which are unacceptable, which defective securities are typically provided with a distinct cancellation mark), and (iii) entirely defective sheets carrying no acceptable security. From this point onward, the three categories of sheets follow distinct routes. More precisely, the entirely defective sheets are destroyed at step S10, while the good sheets are processed at steps S3 to S5 and the partly defective sheets are processed at steps S20 to S23.

Referring to steps S3 to S5, the good sheets are typically numbered at step S3, then optionally varnished at step S4, and finally cut and subjected to an ultimate finishing process at step S5, i.e. stacks of sheets 100 are cut into individual bundles of securities 200, which bundles 200 are typically banderoled (i.e. surrounded with a securing band) and then stacked to form packs of bundles 210. While the sheets 100 are processed in succession at steps S3 and S4, step S5 is usually carried out on stacks of hundred sheets each, thereby producing successive note bundles 200 of hundred securities each, which note bundles 200 are stacked to form, e.g., packs 210 of ten note bundles each.

Referring to steps S20 to S23, the partly defective sheets are firstly cut into individual securities at step S20 and the resulting securities are then sorted out at step S21 (based on the presence or absence of the cancellation mark previously applied at step S2 on the defective securities), the defective securities being destroyed at step S10, while the good securities are further processed at steps S22 and S23. At step S22, the individual securities are numbered in succession and subsequently subjected to a finishing process at step S23 which is similar to that carried out at step S5, i.e. note bundles of securities 200 are formed, which note bundles 200 are banderoled and then stacked to form packs of note bundles 210.

While FIG. 1 is discussed in the context of the production of securities on individual sheets, it shall be understood that the same principle is applicable to the production of securities on a continuous web. In that context, steps S1, S2, S3 and S4 could each be carried by processing a continuous web of printed material, which continuous web is ultimately cut into individual securities.

As regards the varnishing operation, FIG. 1 shows that such varnishing is typically carried out on full sheets at step S4 after full-sheet numbering at step S3. While this varnishing step is preferred, it is not as such required. Varnishing may furthermore be carried out at a different stage of the production, for example before or immediately after full-sheet inspection at step S2 (which other solution would imply that numbering is carried out after varnishing).

In case keeping the numbering sequence throughout the securities of successive bundles 200 is not required, the partly defective sheets could follow a somewhat similar route as the good sheets, i.e. be subjected to a full-sheet numbering step (thereby numbering both the good and defective securities), then to full-sheet varnishing, before being cut into individual securities, sorted out to extract and destroy the defective securities, and then subjected to an ultimate finishing process to form bundles and packs of bundles (in this case single-note numbering would not be required). Such an alternate production process is illustrated in FIG. 2A.

Step S1* in FIG. 2A is similar to step S1 of FIG. 1, i.e. successive sheets 100 are produced, i.e. subjected successively to offset printing, intaglio printing, silk-screen printing, foil/patch application, etc. Step S2* in FIG. 2A is similar to step S3 of FIG. 1, i.e. full sheets are numbered in an appropriate numbering press. In this case however, one shall understand that both good and defective sheets are numbered. The numbered sheets are then optionally varnished at step S3*, before being cut into individual notes at step S4*.

At step S5*, single-note inspection is carried out, i.e. each individual note is inspected from the point of view of quality, and defective notes are sorted out in the process, which defective notes are destroyed at step S7*. The good notes, on the other hand, are then subjected to an ultimate finishing operation at step S6*, i.e. individual note bundles 200 are formed, which note bundles 200 are stacked to form packs 210 of note bundles 200, e.g. packs of ten bundles.

According to a variant of the production process of FIG. 2A, numbering could be carried out in a single-note numbering process before or after the single-note inspection and sorting at step S5*. Such variant is illustrated in FIG. 2B. Steps S1, S2, S3, S4, S6 and S7 respectively correspond to steps S1*, S3*, S4*, S5*. S6* and S7* of FIG. 2A and do not need to be explained again. In the variant of FIG. 2B, as compared to the process of FIG. 2A, full-sheet numbering is replaced by a single-note numbering process (step S5) following the single-note inspection and sorting at step S4. In other words, the good notes sorted out after step S4 are numbered, preferably in a consecutive manner before being bundled and packed at step S6.

For the sake of completeness, one may refer to International applications Nos. WO 01/85457 A1, WO 01/85586 A1, WO 2005/008605 A1, WO 2005/008606 A1, and WO 2005/104045 A2 for an overview of possible full-sheet quality inspection machines to carry out step S2 in FIG. 1. Of particular interest are the machines disclosed in International applications WO 01/85457 A1, WO 01/85586 A1, WO 2005/008605 A1 and WO 2005/008606 A1 which combine the functions of full-sheet quality inspection and full-sheet numbering (which machines can thus perform the operations of steps S2 and S3 in one pass). A full-sheet inspection machine is sold by the Applicant under the trade name Nota Check®, while a combined full-sheet inspection and numbering machine is sold by the Applicant under the trade name Super Check Numerota®.

The interested reader may furthermore refer to U.S. Pat. Nos. 3,939,621, 4,045,944, 4,453,707, 4,558,557, to European patent applications Nos. EP 0 656 309 A1, EP 1 607 355 A1, and to International applications Nos. WO 01/49464 A1, WO 2008/010125 A2/A3, all in the name of the present Applicant, for a discussion of various cutting and finishing machines suitable for carrying out step S5 of FIG. 1. Such machines are for instance sold by the Applicant under the trade name CutPak®. Those machines are easily adaptable to perform only cutting of sheets into individual notes at step S20 of FIG. 1, step S4* of FIG. 2A, or step S3 of FIG. 2**B.

As regards the more specific issue of full-sheet numbering, European patent application No. EP 0 598 679 A1 and International application No. WO 2004/016433 A1 are of interest. The numbering and finishing principle discussed in WO 2004/016433 A1 is of particular interest in this context as it provides for the numbering of sheets in a manner such that bundles of securities are produced in a consecutive and uninterrupted numbering sequence at the end of the finishing process without this requiring any complex bundle collating system. Numbering machines for carrying out full-sheet numbering are for instance sold by the Applicant under the trade name SuperNumerota®, as well as under the above-mentioned Super Check Numerota® trade name.

In the context of single-note sorting and numbering as provided under steps S21 and S22 of FIG. 1, one may refer to U.S. Pat. Nos. 3,412,993, 4,299,325, 4,915,371. A machine combining the functions of single-note sorting and numbering (and optionally bundling and packing) is for instance sold by the Applicant under the trade name NotaNumber®. Such machine could for instance be used to carry out single-note sorting, numbering and finishing in the processes of FIG. 1 (steps S21 to S23) and FIG. 2B (steps S4 to S6).

Single-note inspection and sorting systems for carrying out step S5* in the process of FIG. 2A and step S4 in the process of FIG. 2**B are also known as such in the art.

As regards both production principles illustrated in FIGS. 2A and 2B, several single-note processing stations have to be installed in parallel in order to reach a comparable production efficiency as that of the production principle illustrated in FIG. 1, as this will be explained below.

A conventional production rate of a sheet-fed production line is of the order of 10,000 to 12,000 sheets per hour. The same applies to web-fed production lines. Depending on the sheet layout, such production rate typically corresponds to a note output of between 400,000 to 720,000 notes per hour (it being understood that each sheet typically carries between 40 to 60 notes). Single-note processing systems are limited by the natural laws of physics to a processing speed of approximately 120,000 notes per hour.

In the context of the production principle of FIG. 1, the above-mentioned limitations are not critical as a single-note processing system is only used at steps S21 and S22 to process partly defective sheets, which partly-defective sheets amount to only a small portion (e.g. <10%) of the production volume. In contrast, in the context of the production principles of FIGS. 2A and 2B, the whole production volume is processed at step S5* and S6*, respectively S4 to S6, on a single-note processing system. In other words, in order to cope with the higher production rate of the sheet-fed production line, usually four or five single-note processing stations are used in practice to process the whole production volume in parallel. This will now be explained in reference to FIG. 3 which is also illustrative of the art and shows a possible implementation for carrying out the production principle of FIG. 2A.

In FIG. 3, reference 300 denotes a sheet-fed production line (or sheet-fed processing system), in this example with seven successive sheet-fed printing or processing stations 301 to 307, e.g. an offset printing press 301, a silk-screen printing press 302, a foil application machine 303, an intaglio printing press 304, a numbering press 305, an optional varnishing machine 306 and a cutting machine 307. Stations 301 to 304 perform full-sheet printing of unprinted sheets 100* according to step S1* of FIG. 2A, thereby yielding a set of printed sheets 100 which are numbered at station 305 and then varnished at station 306 before being cut into individual documents or notes 150 at station 307 (i.e. the sheets are processed in succession according to steps S2*, S3* and S4* of FIG. 2A).

As illustrated in FIG. 3, the sheet-fed processing system 300 is coupled to a single-note processing system 400 comprising a plurality of single-note processing stations SNPS 1 to SNPS 4 (also designated by reference numerals 401 to 404) which are coupled to the output of the sheet-printing and processing line 300 to process the individual documents 150 in order to produce bundles 200 and packs 210 of bundles 200 (each station 401 to 404 performing at least steps S5* and S6* of FIG. 2).

Let us consider for the sake of explanation that, in the context of FIG. 3, each printed sheet bears fifty notes, which means that the production capacity of the sheet-fed production line would be of 500,000 notes per hour at a sheet-processing speed of 10,000 sheets per hour. In this case, and considering a single-note processing speed of 120,000 notes per hour, four single-note processing systems are required to best match the production speed of the sheet-fed processing system 300, such being the case in the illustration of FIG. 3.

In order to implement the production principle of FIG. 2B, a similar production facility as that illustrated in FIG. 3 could be used. The only difference would reside in the fact that the numbering press 305 would be discarded and that each single-note processing station SNPS 1 to SNPS 4 would be provided with its own numbering capability to carry out the single-note numbering process of step S5 of FIG. 2**B.

An improved solution for performing the production principle of FIG. 2A or 2B is discussed in International application No. WO 2008/126005 A1 in the name of the present Applicant.

Irrespective of the methodology that is adopted to process the printed sheets into individual documents, the sheets must undergo a finishing process where the sheets are stacked and cut to form individual documents as explained in connection with steps S5 and S20 of FIG. 1, step S4* of FIG. 2A or step S3 of FIG. 2**B. This requires a suitable cutting and finishing machine for carrying out the cutting of the sheets in a precise manner.

As already mentioned, such cutting and finishing machines (as designated for instance by reference numeral 307 in FIG. 3) are already known in the art, for instance from U.S. Pat. Nos. 3,939,621, 4,045,944, 4,453,707, 4,558,557, European patent applications Nos. EP 0 656 309 A1, EP 1 607 355 A1, and International applications Nos. WO 01/49464 A1 and WO 2008/010125 A2/A3, all in the name of the present Applicant.

According to these known machines, the sheets are cut row-wise and column-wise while a predetermined number thereof (e.g. hundred) are stacked one upon the other. However, depending on the type of substrate used, the type and location of security features and various other process-related or design-related issues, stacking of the sheets may lead, as schematically illustrated in FIG. 5, to a substantial overall waviness $\Delta H$ of the sheet stacks, H designating the sheet stack height, while L and W respectively designate the sheet length and sheet width (see also FIG. 4). In particular, while the sheet at the bottom of the sheet stack may lie substantially flat, waviness increases as one moves to the upper sheets in the sheet stack. This waviness, which is not constant over the whole height of the sheet stack, can negatively affect the cutting accuracy row-wise and/or column-wise, possibly leading to cutting errors. In the schematic illustration of FIG. 5 where the waviness is particularly present along the X axis, this waviness can lead to cutting errors $\Delta X$ of the Y-cut, i.e. the cut along the Y axis. Moreover, since the waviness increases as one moves to the upper sheets in the sheet stack, the effective size of the documents cut row-wise and column-wise from the sheet stack will vary between the bottom sheet and the top sheet of the sheet stack, thereby leading to individual documents having varying sizes, which is not desired.

An improved solution for processing printed sheets into individual documents is therefore required.

SUMMARY OF THE INVENTION

An aim of the invention is thus to provide such an improved solution.

In particular, an aim of the present invention is to provide a method and system for processing printed sheets into individual documents that overcomes the limitations of the known methods and systems.

These aims are achieved thanks to the method and system defined in the claims.

According to the present invention, a method of processing printed sheets, especially sheets of printed securities, into individual documents, such as banknotes, is provided, wherein each printed sheet comprises an array of imprints arranged in a matrix of rows and columns. The method comprises the following steps:

- pre-processing the printed sheets by partly slitting each printed sheet row-wise or column-wise to form slits between adjacent rows or adjacent columns of imprints, slitting being performed in such a manner that the adjacent rows or adjacent columns of imprints are still attached to one another at edges of each thus pre-processed printed sheet;
- stacking the pre-processed printed sheets so as to form sheet stacks comprising a predetermined number of pre-processed printed sheets stacked one upon the other; and
- processing the sheet stacks by cutting each sheet stack column-wise or row-wise along cutting lines between adjacent columns or rows of imprints, cutting being performed along a direction perpendicular to the direction of the slits and in such a manner that individual documents are produced as a result.

Similarly, a system for processing printed sheets, especially sheets of printed securities such as banknotes, into individual documents is provided, wherein each printed sheet comprises an array of imprints arranged in a matrix of rows and columns, the system comprising:

- a slitting unit for pre-processing the printed sheets by partly slitting each printed sheet row-wise or column-wise to form slits between adjacent rows or adjacent columns of imprints, slitting being performed in such a manner that the adjacent rows or adjacent columns of imprints are still attached to one another at edged of each thus pre-processed printed sheet;
- a stacking unit for stacking the pre-processed printed sheets so as to form sheet stacks comprising a predetermined number of pre-processed printed sheets stacked one upon the other; and
- a cutting unit for processing the sheet stacks by cutting each sheet stack column-wise or row-wise along cutting lines between adjacent columns or rows of imprints, cutting being performed along a direction perpendicular to the direction of the slits and in such a manner that individual documents are produced as a result.

According to a preferred embodiment of the method and system, the pre-processing of the printed sheets further includes trimming of sheet edges of each printed sheet, which sheet edges are parallel to the slits. Similarly, according to another preferred embodiment of the method and system, the processing of the sheet stacks further includes trimming of sheet edges of each pre-processed printed sheet within the sheet stacks, which sheet edges are parallel to the cutting lines.

Advantageously, slitting of the printed sheets, and optional trimming of the sheet edges of the printed sheets is carried out using a laser cutting unit or a rotary knife system.

Once processed into individual documents, the individual documents can conveniently be inspected and/or sorted using an inspecting and/or sorting unit, such as already discussed hereinabove in reference to FIGS. 1 to 3.

The method may further comprise the step of providing at least one alphanumeric number or coding onto at least part or all of the individual documents after processing of the sheet stacks or onto at least part or all of the imprints of at least some of the printed sheets prior to pre-processing thereof. In that context, a suitable numbering unit might be provided for providing this at least one alphanumeric number or coding, such as a sheet numbering press or group for numbering the printed sheets prior to pre-processing thereof or a single-note numbering press or group for numbering the individual documents following processing of the printed sheets.

The individual documents can ultimately be bundled to form individual bundles and optionally be provided with at least one securing band around the individual bundles.

According to an advantageous embodiment wherein the printed sheets exhibit at least one security element, such as a security thread or the like, which security element extends row-wise or column-wise over or into the printed sheets, slitting of the printed sheets is performed along a direction parallel to the security element.

In this particular context, and assuming that the security element is such that it impacts on an overall waviness of sheet piles or stacks when the printed sheets are piled or stacked one upon the other, stacking of the pre-processed printed sheets may include piling of the pre-processed printed sheets in a staggered manner along a direction perpendicular to the direction of the slits so as to minimize the impact of the security element on the overall waviness of the resulting sheet piles or stacks.

Thanks to the above method and system, cutting accuracy can be improved, especially in cases where the printed sheets to be processed exhibit a substantial waviness caused by process-related and/or design-related factors. In particular, by performing partial row-wise or column-wise slitting of the sheets between the rows or columns of imprints, an accurate cutting in the X or Y direction can be achieved, while ensuring that the thus pre-processed sheets can be stacked on upon the other to form sheet stacks that can be further processed, i.e. be cut along cutting lines perpendicular to the slits, in such a way as to form individual documents, which stack processing guarantees a high productivity rate.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Figure 4:
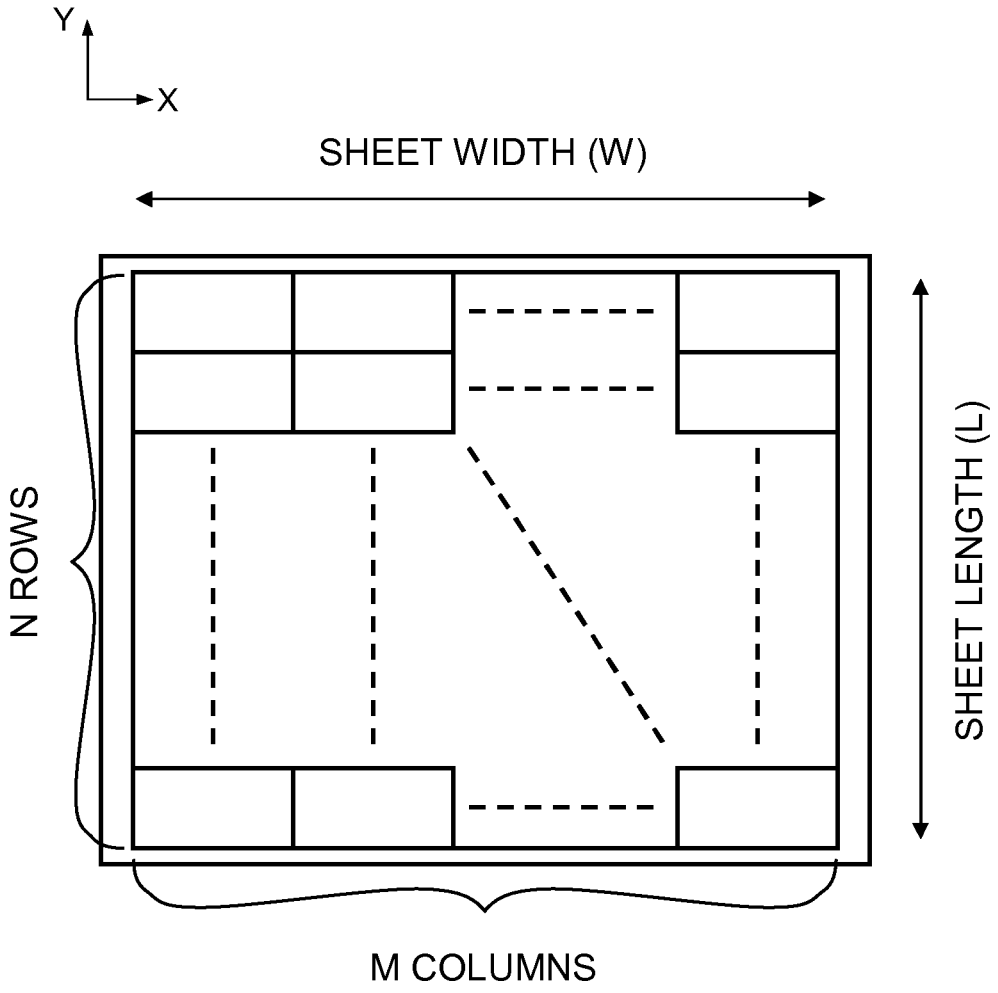
FIG. 4 is a schematic view of a sheet layout illustrating the notions of "columns", "rows", "sheet length" and "sheet width" with the scope of the present invention.

Within the scope of the present invention, and for the sake of clarity, the term "column" should be understood as referring to the arrangement of imprints one next to the other along a first dimension of the sheets, hereinafter referred to as the "sheet length L", while the term "row" should be understood as referring to the arrangement of security prints one next to the other along the other dimension of the sheets, hereinafter referred to as the "sheet width W", as schematically illustrated in FIG. 4. Strictly speaking, the terms "column"/"row" and "sheet width"/"sheet length" are however interchangeable. According to the above definition, the sheet length L typically corresponds to the dimension of the sheets (or web portions) parallel to a transport direction of the sheets (or of the continuous web) through the printing press or presses that were used to carry out the printing operations (axis Y in the Figures), while the sheet width corresponds to the dimension of the sheets transversely to the transport direction of the sheets or of the continuous web (axis X in the Figures). The sheet width W is typically greater than the sheet length L.

As is typical in the art, the dimensions (whether of individual sheets processed on sheet-fed printing presses or of successive web portions of a continuous web processed on web-fed printing presses) may for instance be as much as 820 mm in width per 700 mm in length (i.e. 820×700 mm). With such sheet dimensions, six (M=6) columns per ten (N=10) rows of security prints with dimensions of e.g. 130×65 mm might for instance be provided on the sheets. With sheet dimensions of 740×680 mm, four (M=4) columns per seven (N=7) rows of security prints with dimensions of e.g. 180×90 mm might for instance be provided on the sheets. For small sheet dimensions, e.g. of 420×400 mm, four (M=4) columns per six (N=6) rows of security prints with dimensions of e.g. 100×60 mm might for instance be provided on the sheets. The above examples are of course given for the purpose of illustration only.

As already mentioned hereinabove, the methodology according to the invention for processing the printed sheets into individual documents basically comprises the following steps:

pre-processing the printed sheets by partly slitting each printed sheet row-wise or column-wise to form slits between adjacent rows or adjacent columns of imprints, slitting being performed in such a manner that the adjacent rows or adjacent columns of imprints are still attached to one another at edges of each thus pre-processed printed sheet;

stacking the pre-processed printed sheets so as to form sheet stacks comprising a predetermined number of pre-processed printed sheets stacked one upon the other; and processing the sheet stacks by cutting each sheet stack column-wise or row-wise along cutting lines between adjacent columns or rows of imprints, cutting being performed along a direction perpendicular to the direction of the slits and in such a manner that individual documents are produced as a result.

Figure 5:
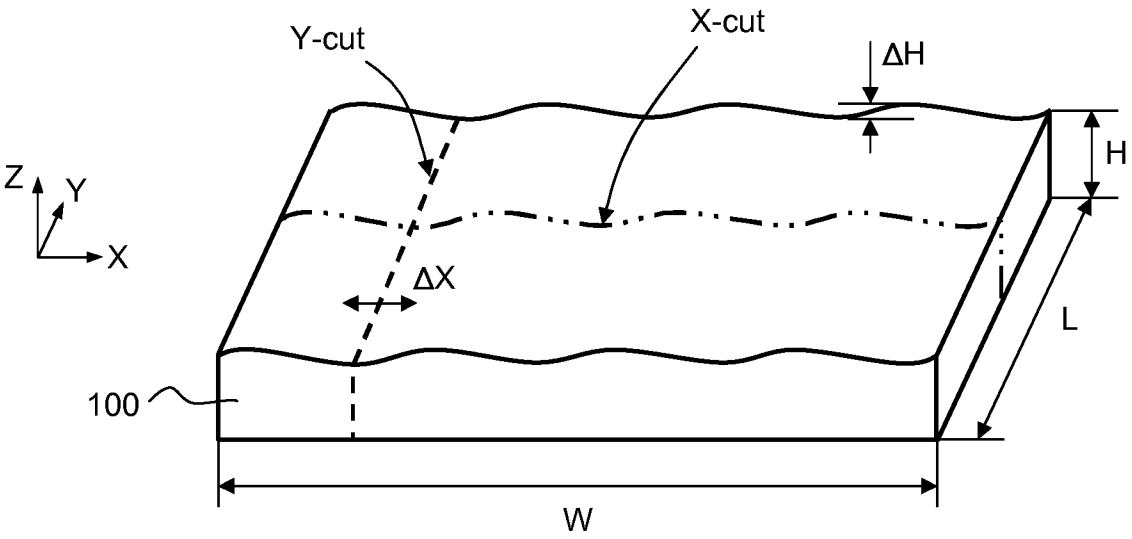
FIG. 5 is a schematic perspective view of a sheet stack comprising multiple sheets stacked one upon the other, which view further illustrates how overall waviness of the sheet stack can effect cutting accuracy.
Figure 6A:
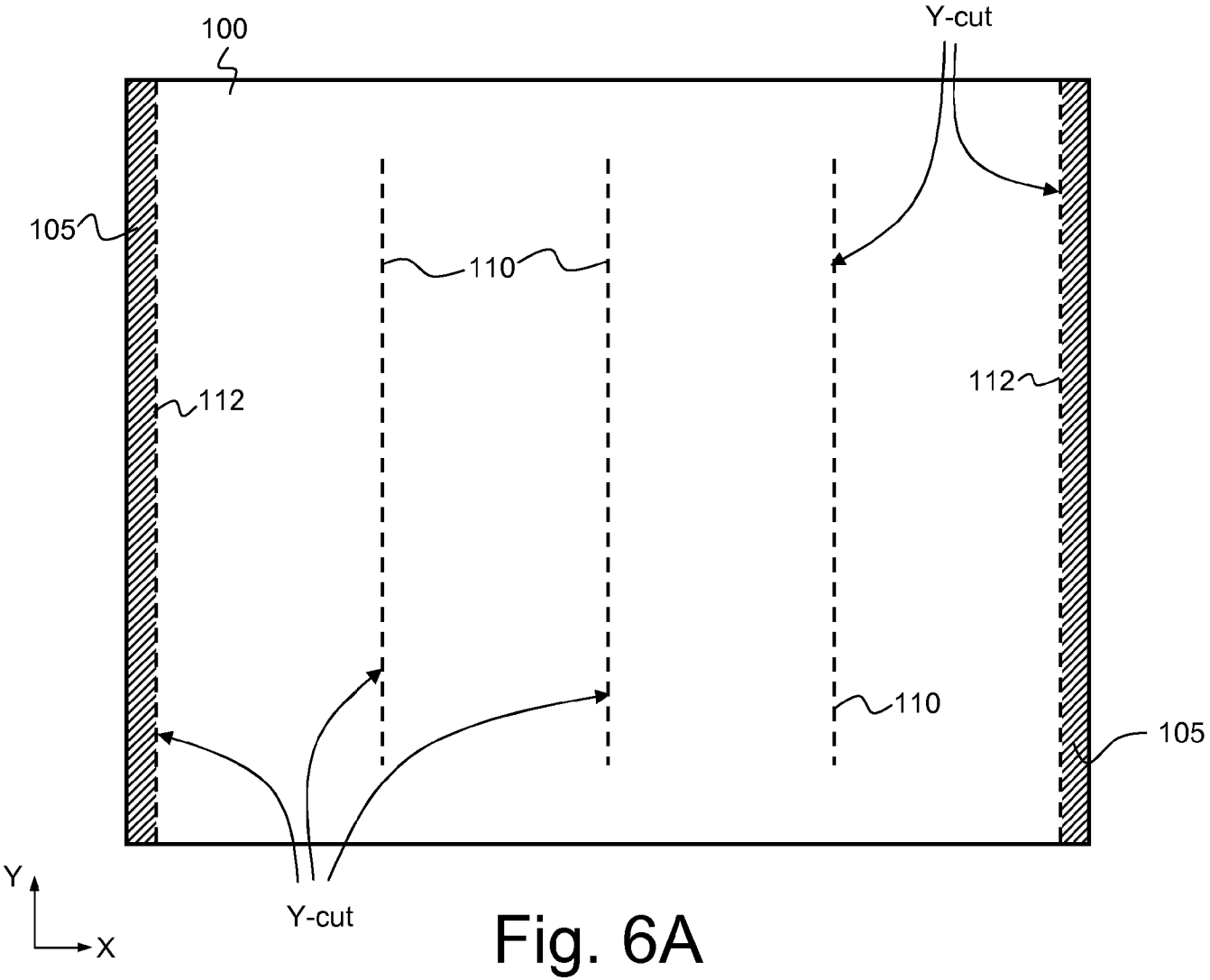
FIGS. 6A and 6B respectively illustrate the pre-processing step (i.e. slitting) and processing step (i.e. cutting) according to the invention.

The above pre-processing step is illustrated by FIG. 6A. For the sake of explanation it will be assumed in the following that the waviness is particularly noticeable along the X axis as illustrated in FIG. 5 and that each printed sheets carries M=4 columns per N=6 rows of imprints. Accordingly, and in order to cope with the waviness, the printed sheets 100 are pre-processed as illustrated in FIG. 6A by slitting each printed sheet 100 column-wise to form slits 110 between adjacent columns of imprints. In this example, three slits 110 are formed between the four columns of imprints. Obviously, if the waviness is present along the Y axis, the printed sheets 100 would be pre-processed by carrying out the slitting row-wise between adjacent rows of imprints.

The slitting is carried out partly along the length of the sheets in such a manner that the adjacent columns of imprints are still attached to one another at edges of each thus pre-processed printed sheet. This is schematically illustrated in FIG. 6A by dashed lines 110 which do not extend along the full sheet length, but rather along the length of the area of the printed sheet that is effectively printed with imprints, there remaining typically edges (or margins) on the sheets which are discarded during the finishing process and do not carry information that is ultimately found on the final documents. It is to be understood in this example that each slit 110 runs continuously from one end of the area printed with imprints to the other and stop in the sheet margins.

FIG. 6A shows two sheet edges extending parallel to the slits 110 which are designated by reference numeral 105. Preferably, the pre-processing of the printed sheets 100 further includes trimming of these sheet edges 105 which are evacuated as waste material. In contrast to the slitting operation, trimming of the sheet edges 105 involves cutting of the sheets over their full sheet length along cutting lines that are designated by reference numeral 112 in FIG. 6A.

In FIG. 6A, the slits 110 and cuts 112 can jointly be designated as "Y-cuts" in the sense that these are performed along a direction parallel to the Y axis. In other words, in the example of FIG. 6A, a total of five Y-cuts are carried out in parallel, namely three slits 110 and two side cuts 112.

Figure 6B:
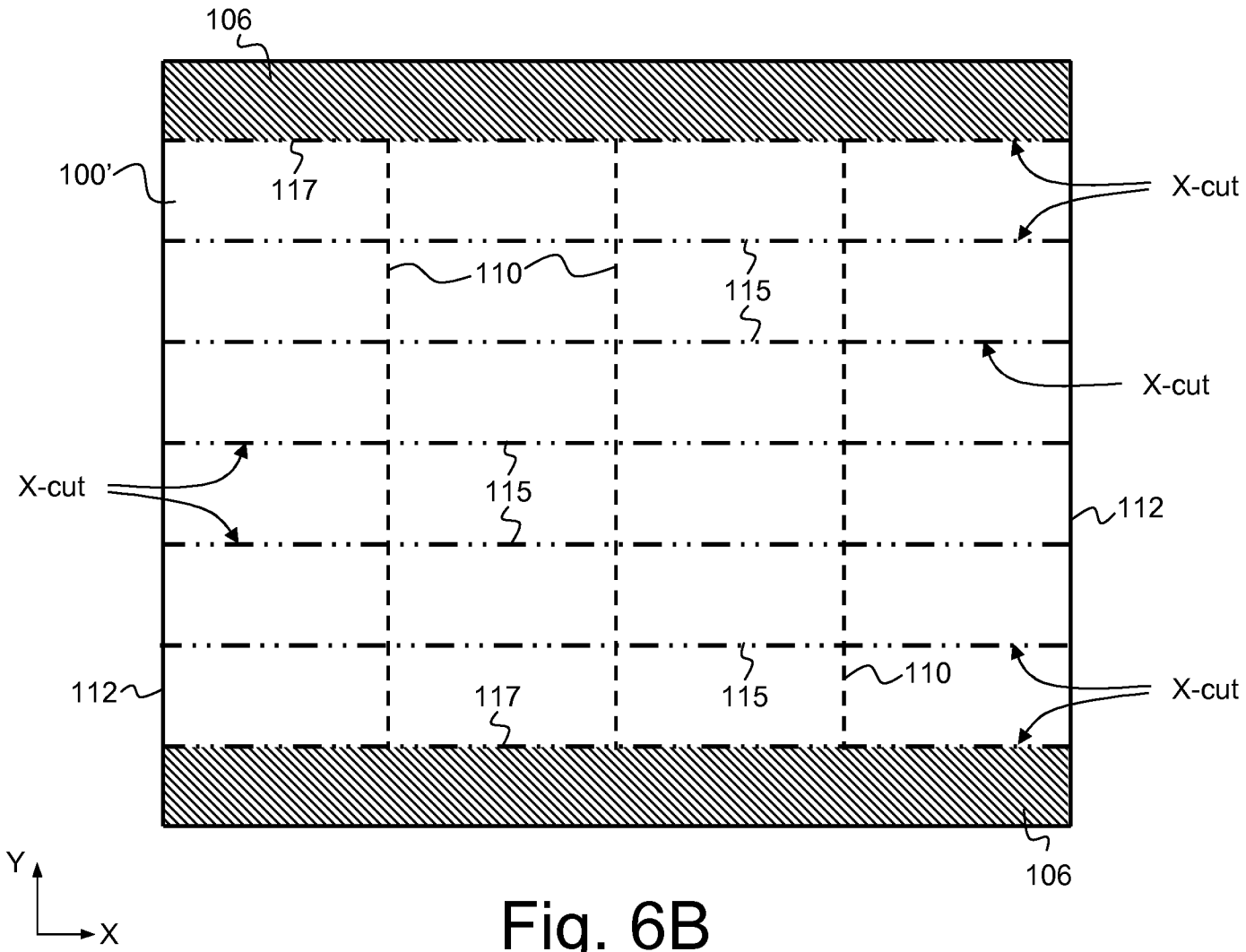

The above-mentioned subsequent processing step is illustrated by FIG. 6B. This Figure shows the pre-processed printed sheets, designated by reference numeral 100', which are obtained as a result of the pre-processing step discussed hereabove in connection with FIG. 6A, i.e. printed sheets the sheet edges 105 of which have been cut and wherein slits 110 have been provided along the Y axis. In FIG. 6B, the edges on the left and right sides of the pre-processed printed sheets 100' thus correspond to the cutting lines 112 in FIG. 6A.

Prior to carrying out the subsequent processing step of FIG. 6B, the pre-processed printed sheets 100' are stacked so as to from sheet stacks comprising a predetermined number, e.g. hundred, of pre-processed printed sheets 100' stacked one upon the other. Once such sheet stacks are formed, each sheet stack can then be subjected to the processing step as illustrated in FIG. 6B. In the context of FIG. 6B, it will thus be appreciated that the processing step involves cutting of a complete sheet stack.

In the example of FIG. 6B, since the slits 110 have been formed column-wise, i.e. along the Y axis, cutting of each sheet stack is performed row-wise along cutting lines between adjacent rows of imprints. Such cutting lines are depicted in FIG. 6B by dashed lines parallel to the X axis and are designated by reference numeral 115. Such cutting lines extend over the full width of the sheets.

In addition, the processing of the sheet stacks preferably further includes trimming of sheet edges 106 of each pre-processed printed sheet 100' within the sheet stacks, which sheet edges 106 extend parallel to the cutting lines 115 and are also evacuated as waste material. Cutting of the sheet stack therefore further includes cutting of the sheet stack along two additional cutting lines 117 as illustrated in FIG. 6B.

In FIG. 6B, the cuts 115, 117 can jointly be designated as "X-cuts" in the sense that these are performed along a direction parallel to the X axis. In other words, in the example of FIG. 6A, a total of seven X-cuts are carried out in parallel, namely five cuts 115 and two side cuts 117.

As a result of the above-mentioned processing step, each sheet stack is thus cut and separated into a plurality of sets of individual documents. In the example of FIGS. 6A and 6B, and considering that each sheet stack is formed of hundred sheets, the processing of each sheet stack yields to the formation of twenty-four sets of hundred individual documents each, i.e. two thousand and four hundred individual documents.

These individual documents can then be further processed, collected and/or assembled in any appropriate manner. This may in particular include inspection and/or sorting of the individual documents in order for instance to discard defective documents that would not meet desired quality requirements.

Figure 1:
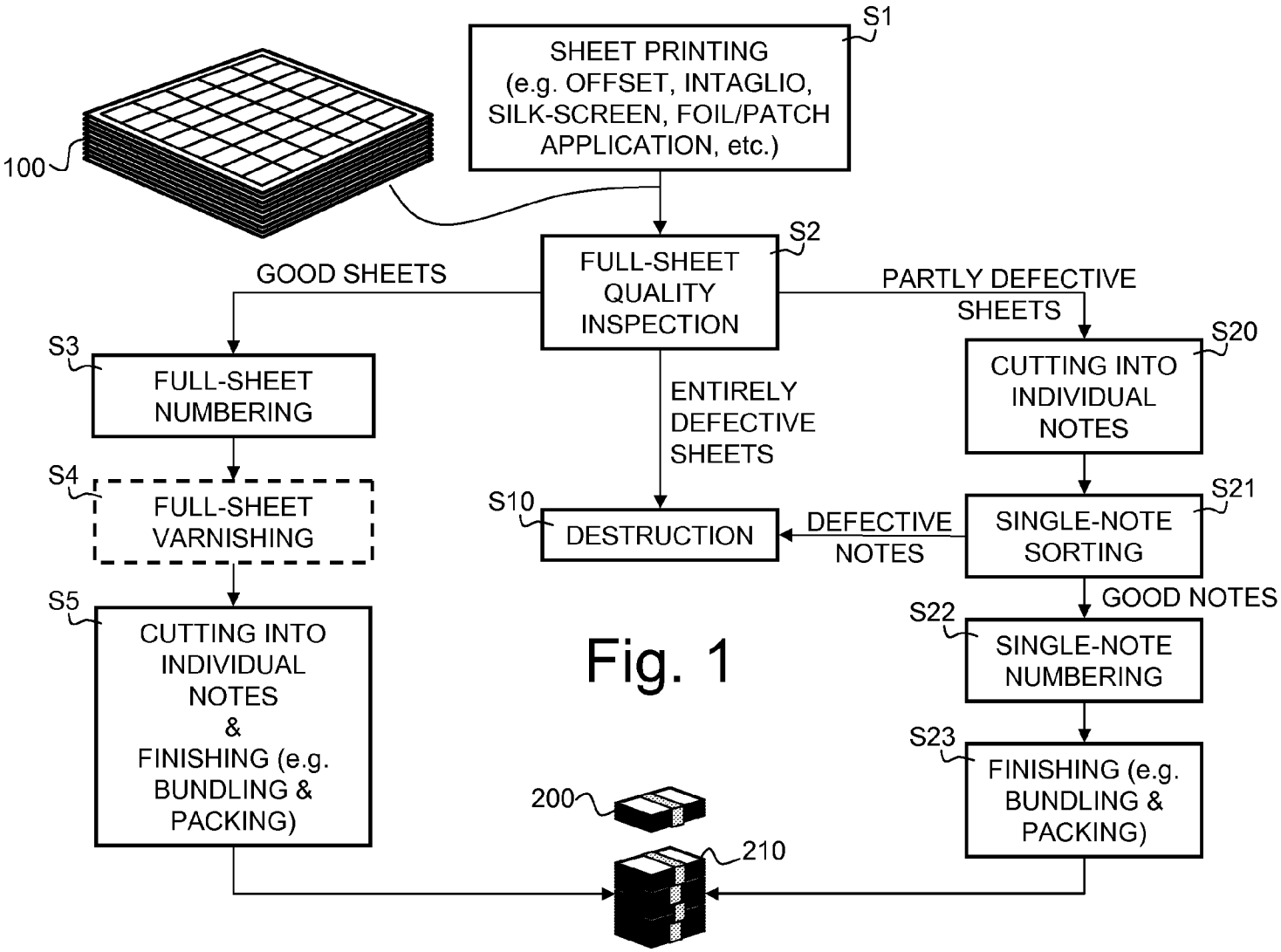
FIG. 1 is a flow chart illustrating a known process for producing notes of securities wherein only a small part of the production is subjected to single-note processing.
Figure 2A:
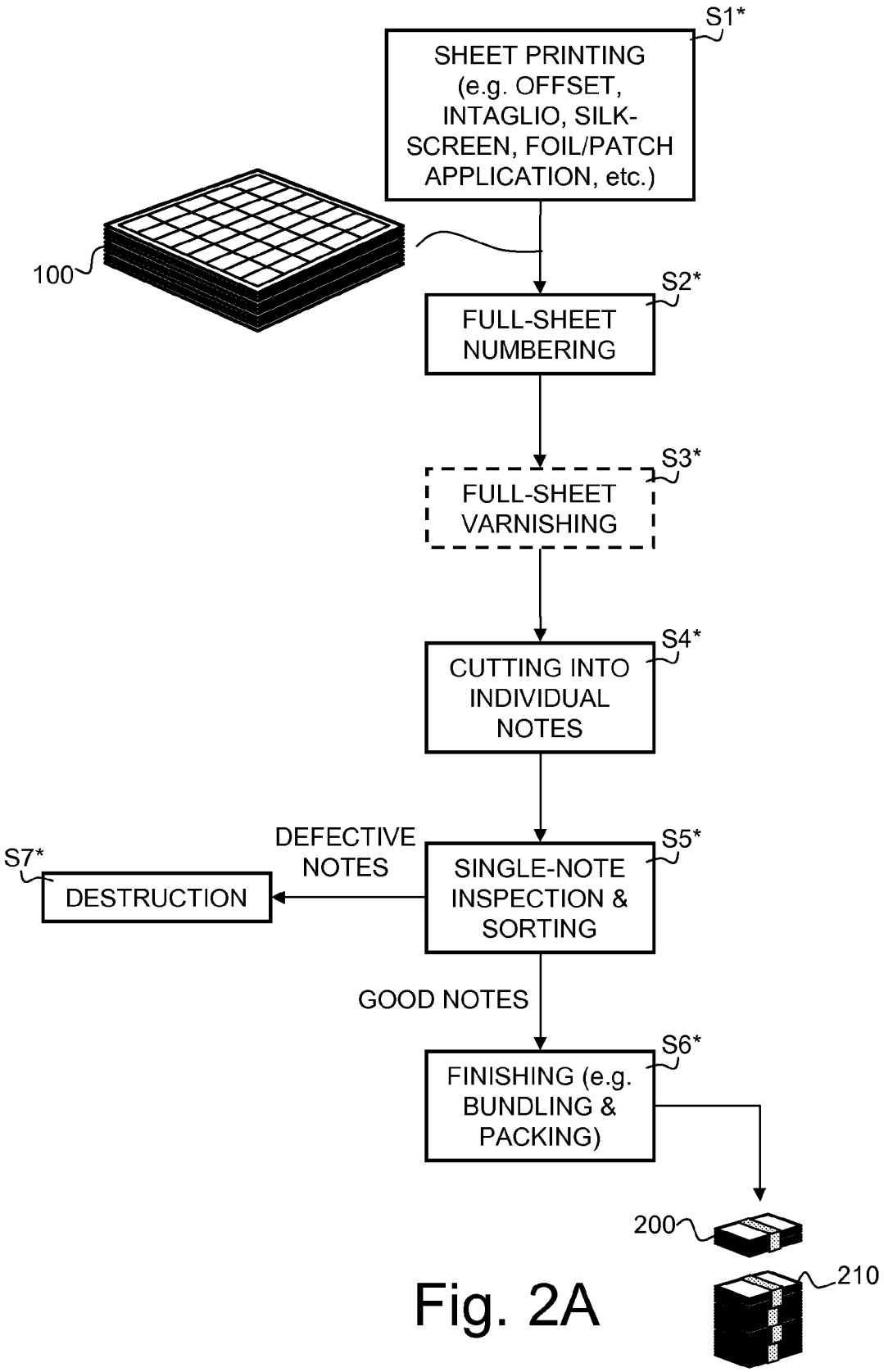
FIG. 2A is a flow chart illustrating a known alternative process for producing notes of securities wherein all the production is subjected to single-note processing.
Figure 2B:
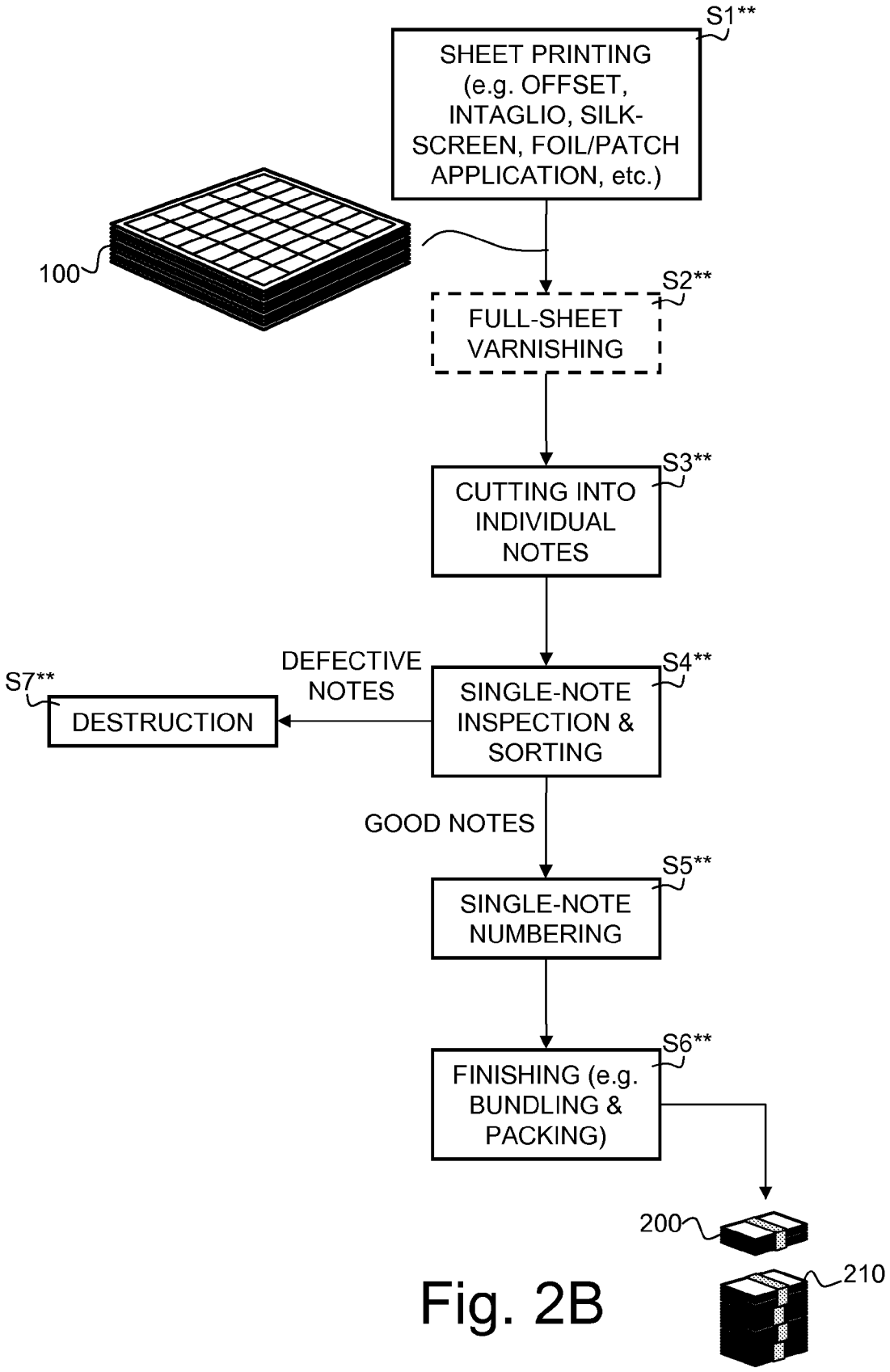
FIG. 2B is a flow chart illustrating a variant of the process of FIG. 2A for producing notes of securities wherein all the production is subjected to single-note processing.
Figure 3:
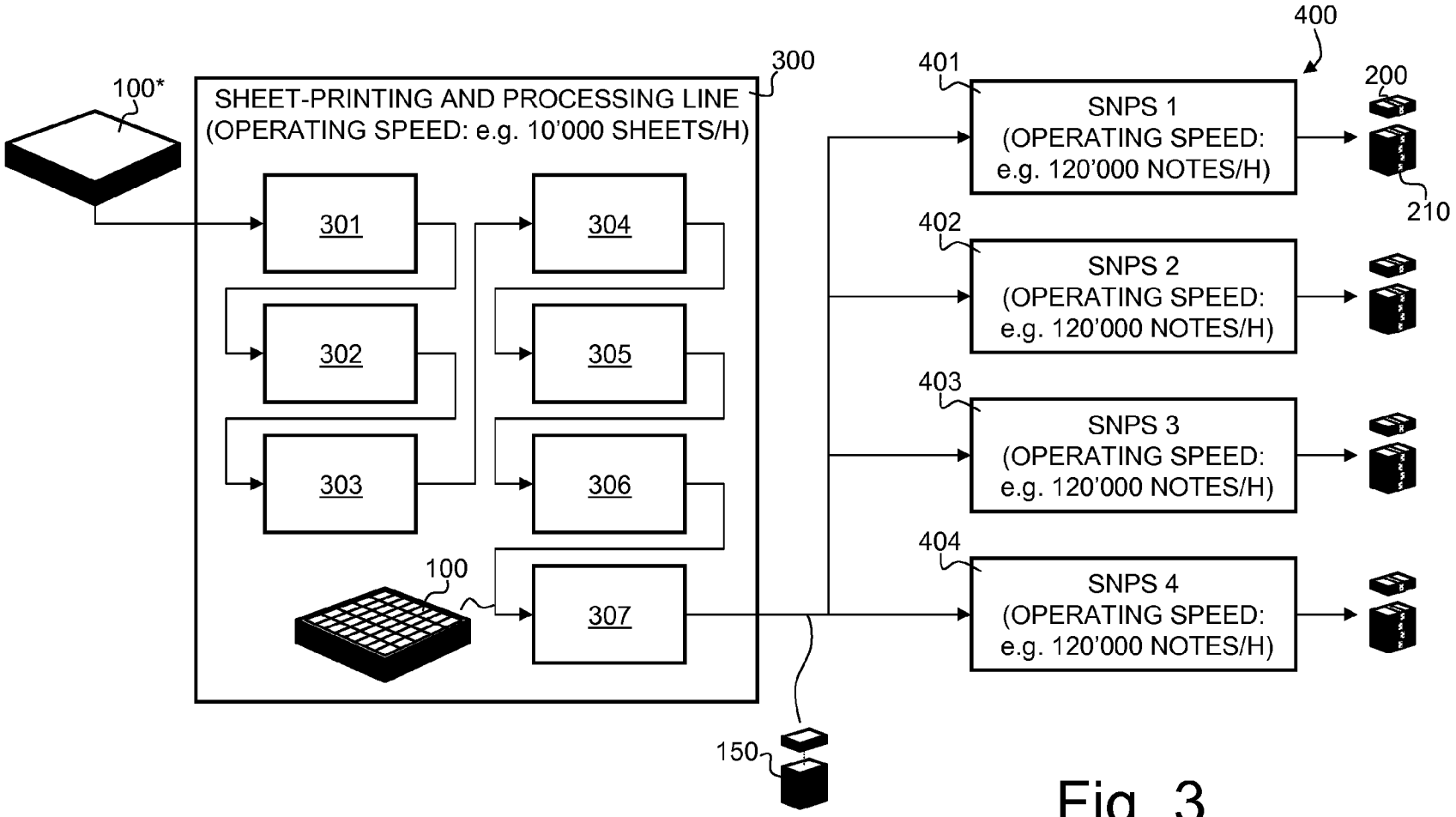
FIG. 3 is a schematic illustration of a production facility according to a known implementation of the production process of FIG. 2A.

Further processing may further include the step of providing at least one alphanumeric number or coding onto at least part or all of the individual documents after processing of the sheet stacks, as already discussed hereinabove in connection with step S22 of FIG. 1 or step S5 of FIG. 2**B using a suitable single-note numbering system.

As far as numbering (or coding) of each individual document is concerned, an alternate solution may consist in providing the at least one alphanumeric number or coding onto at least part or all of the imprints of at least some of the printed sheets 100 prior to pre-processing thereof, i.e. in a sheet or web process, as already discussed hereinabove in connection with step S3 of FIG. 1 or step S2* of FIG. 2A using a suitable numbering system.

Once the sheet stacks have been fully processed, i.e. cut, into individual documents, such individual documents may further be bundled to form individual bundles and be optionally provided with at least one securing band around the individual bundles. Such bundling is known as such in the art and a suitable banding system is for instance disclosed in International application No. WO 2005/085070 A1 in the name of the Applicant.

Figure 7:
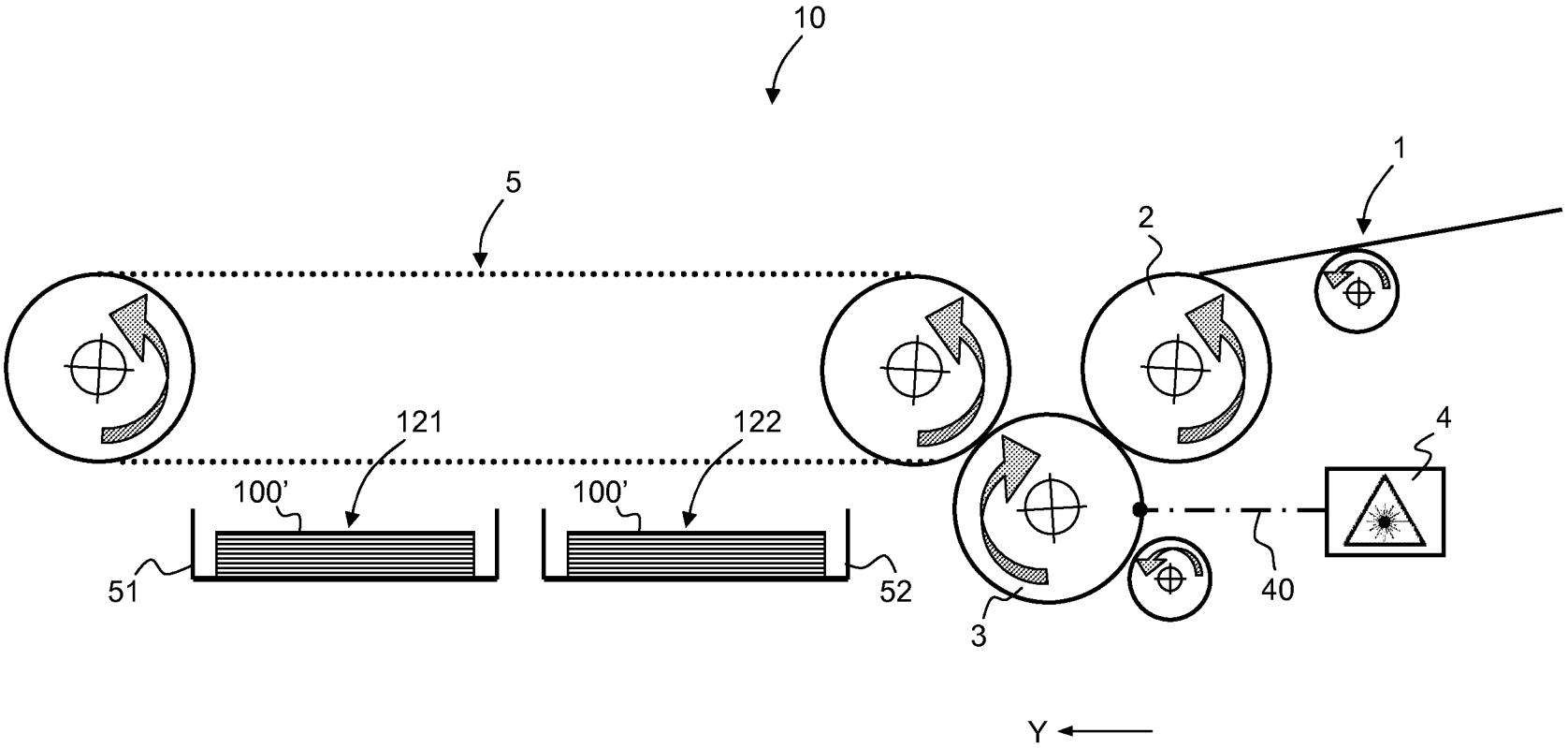
FIG. 7 schematically illustrates a processing system for carrying out slitting and optional trimming of the sheet edges of the printed sheets as well as stacking of the thus pre-processed printed sheets.

FIG. 7 schematically illustrates a processing system 10 for carrying out slitting and optional trimming of the sheet edges of the printed sheets 100 as discussed in reference to FIG. 6A as well as stacking of the thus pre-processed printed sheets 100'.

This processing system 10 includes a sheet feeding table 1 onto which successive printed sheets 100 are fed one after the other, each printed sheet 100 being fed to a transfer cylinder 2 which forwards the printed sheets to a downstream-located processing cylinder 3. In this example, a laser cutting unit 4 is provided for carrying out the slitting and trimming of the printed sheets 100, which laser cutting unit 4 is designed to direct one or more laser beams 40 against the surface of the printed sheet 100 that is being carried by the processing cylinder 3.

Timing of the laser cutting unit 4 is controlled in such a way as to slit and trim the printed sheets 100 along the Y axis (the Y axis corresponding to the direction of displacement of the printed sheets in FIG. 7) as discussed in reference to FIG. 6A. Once pre-processed, the printed sheets are transferred from the processing cylinder 3 to a downstream-located conveyor system 5 (such as a chain conveyor with spaced-apart gripper bars as already known in the art) in order to be stacked in at least one delivery pile unit 51, 52, two such units being provided in the system of FIG. 7. A predetermined number (e.g. hundred) of the thus pre-processed printed sheets 100' are stacked in succession in the delivery pile units 51, 52, the pre-processed printed sheets 100' being stacked in one delivery pile unit, while the other is being emptied. In this may, corresponding sheet stacks 121, 122 are formed in each delivery pile unit 51, 52. Obviously more than two delivery piles units could be provided.

The processing system 10 may alternatively be made an integral part of an existing printing or processing press. In such case, sheets could be transferred to the processing cylinder 3 directly from an upstream-located cylinder or drum of a printing or processing unit of the press (which would not necessitate the feeding table 1 of FIG. 7). The processing system 10 may in particular and conveniently be made an integral part of a sheet numbering press and be disposed downstream of the numbering group where full sheet numbering would be carried out before being delivered to the delivery pile units 51, 52.

An alternate solution for carrying out the slitting and optional trimming of the printed sheets 100 may consist in using a rotary knife system in lieu of the laser cutting unit 4. Such rotary knife systems are known as such in the art, for instance from International application No. WO 99/33735 A1 also in the name of the Applicant which discloses both transverse and longitudinal rotary knife systems for cutting sheets transversely or longitudinally with respect to the sheet transport direction. Such systems might be adapted to carry out the above-mentioned slitting operation by designing the rotary knife systems in such a way that they do not entirely cut the sheets, but rather slit them over only part of the length (or width) thereof.

The slitting system discussed in reference to FIG. 7 may either be designed as a stand-alone unit or preferably integrated as an additional unit of a printing or processing press. Inspection means may further be provided to check and control the accuracy of the slitting and/or trimming operation.

Figure 8:
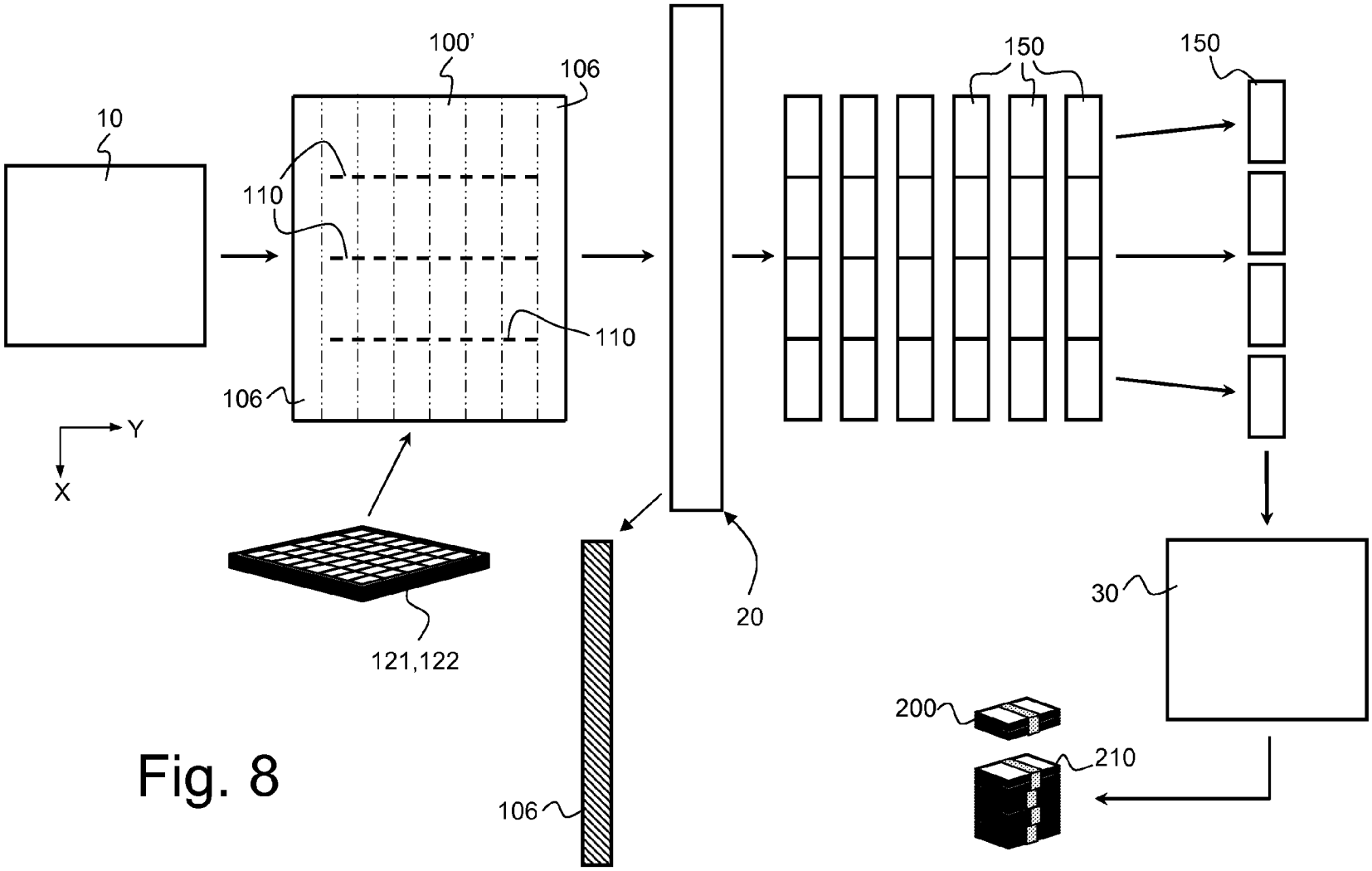
FIG. 8 schematically illustrates a system for carrying out the method of the invention according to a preferred embodiment.

FIG. 8 is a schematic illustration of a system for carrying out the method of the invention according to a preferred embodiment. Reference numeral 10 jointly denotes a pre-processing and stacking system 10 (such as discussed above in reference to FIG. 7) for pre-processing the printed sheets by partly slitting (and optionally trimming) each printed sheet 100 as discussed hereinabove, which system 10 delivers successive sheet stacks 121, 122 each comprising a predetermined number (e.g. 100) of pre-processed printed sheets 100'.

The sheets stacks 121, 122 of pre-processed printed sheets 100' are then fed in succession to a cutting unit 20 which carries out cutting thereof along the cutting lines 115 (see again FIG. 6B), cutting being performed along a direction perpendicular to the direction of the slits 110 as illustrated. Advantageously, the sheet edges 106 are also cut and evacuated as waste material. In this may, individual documents 150 (in this case twenty-four sets each comprising hundred individual documents) are produced as a result. Operation of the cutting unit 20 does not need to be detailed here as such a cutting unit 20 is conventional in the art of finishing.

As illustrated, these individual documents 150 can then be further processed in a downstream-located unit 30, such as an inspecting, sorting, numbering and/or banderoling unit. In the illustrated example, the banknotes are in particular bundled to form individual bundles 200 of e.g. hundred documents, which bundles 200 are advantageously provided with at least one securing band around them, and then packed into bundle packs 210.

Figure 9:
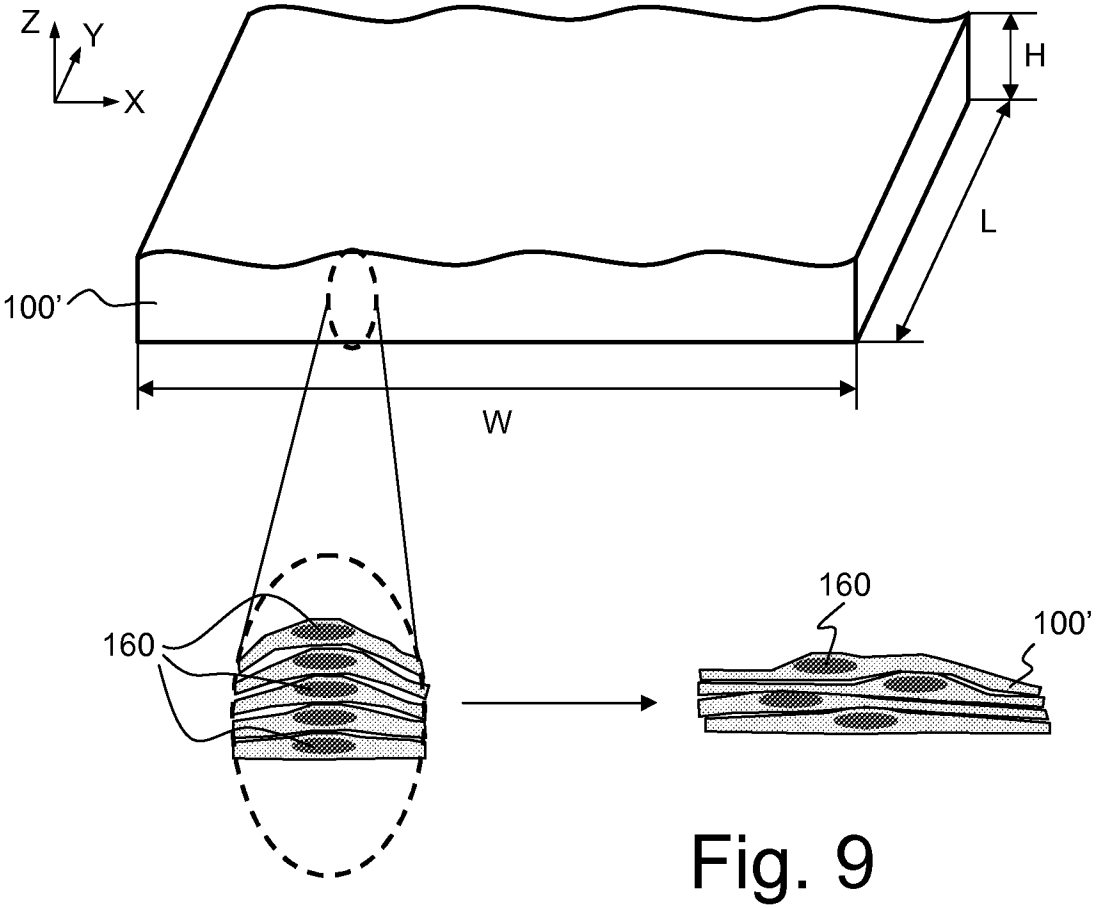
FIG. 9 is a schematic perspective view of a sheet stack as in FIG. 5, wherein the printed sheets exhibit at least one security element, such as a security thread or the like, which extends column-wise inside the substrate of the printed sheets, which security element is such that it impacts on an overall waviness of the sheet stacks.

FIG. 9 schematically illustrates a further refinement of the invention which is particularly advantageous in certain contexts. FIG. 9 is a schematic perspective view of a sheet stack as in FIG. 5, wherein the printed sheets 100 exhibit at least one security element 160 which extends column-wise (or alternately row-wise) along the substrate's plane. In this schematic example, the security element 160 is a thread-like element embedded inside the substrate material.

Typically, security threads are embedded in the paper pulp at the time of the paper manufacture and the location thereof is intentionally varied from one banknote position and/or sheet to the other such that the security thread does not have too much of an impact on the overall waviness of the sheet piles or stacks. This is efficient as long as the dimensions (especially the width and thickness) of the security threads are small. There is however an increasing trend to incorporate larger and/or thicker security threads in security papers and it therefore becomes much more difficult to cope with the resulting waviness of the sheet piles and stacks in production environments. A recent example of such trend is the new Swedish 1000 Kronor banknote which was issued by the Riksbank (http://www.riksbank.se/) on Mar. 15, 2006 and which incorporates the so-called Motion® security thread (Motion® is a registered trademark of Crane & Co. Inc., 30 South Street, Dalton, Mass. 01226, USA).

Due to the dimensions of such security elements, there results a substantial impact on the overall waviness of the sheets piles or stacks when printed sheets are piled or stacked one upon the other. In order to cope with this situation, the pre-processed printed sheets 100' may be piled one upon the other in a staggered manner along a direction perpendicular to the direction of the slits 110 as illustrated in the lower right part of FIG. 9 (in this case, the slits 110, not shown in the Figure, would extend along direction Y and the sheets would be staggered along direction X as illustrated). In this way, one minimizes the impact of the security element 160 on the overall waviness of the resulting sheet piles, resulting in more uniform sheet piles that can be handled, stored and/or transported more easily. As long as the pre-processed printed sheets 100' are staggered along a direction perpendicular to the direction of the slits 110, this does not impact on the cutting accuracy (along direction Y in this case) and the subsequent processing of the pre-processed printed sheets 100', namely cutting along a direction perpendicular to the direction of the slits 110 (along direction X in FIG. 9), can be carried out directly on the staggered pile of pre-processed printed sheets 100'.

It will be understood that various modifications and/or improvements obvious to the person skilled in the art can be made to the embodiments described hereinabove without departing from the scope of the invention defined by the annexed claims.

For instance, while it is preferred to carry out slitting of the sheets so as to form continuous slits, it may be envisaged to perform slitting of the sheets such as to leave residual uncut portions between the rows or columns of imprints, for instance at the locations where the X-cuts and Y-cuts intersect.

The invention claimed is:

1. A method of processing printed sheets, into individual documents, each printed sheet comprising an area that is printed with an array of imprints arranged in a matrix of rows and columns, said method comprising the following steps:

pre-processing said printed sheets by partly slitting each printed sheet row-wise or column-wise to form slits between adjacent rows or adjacent columns of imprints, slitting being performed in such a manner that said adjacent rows or adjacent columns of imprints are still attached to one another at edges of each thus pre-processed printed sheet, each slit running continuously from one end to another of the area printed with the array of imprints and stopping in margins of the printed sheet;

stacking the pre-processed printed sheets so as to form sheet stacks comprising a predetermined number of pre-processed printed sheets stacked one upon the other; and processing said sheet stacks by cutting each sheet stack column-wise or row-wise along cutting lines between adjacent columns or rows of imprints, cutting being performed along a direction perpendicular to the direction of the slits and in such a manner that individual documents are produced as a result, wherein said printed sheets exhibit at least one security element which extends row-wise or column-wise over or into said printed sheets and wherein slitting of the printed sheets is performed along a direction parallel to said security element, wherein said security element is such that it impacts on an overall waviness of sheet piles or stacks when said printed sheets are piled or stacked one upon the other, and wherein said stacking of the pre-processed printed sheets includes piling of the pre-processed printed sheets in a staggered manner along a direction perpendicular to the direction of said slits so as to minimize the impact of the security element on the overall waviness of the resulting sheet piles or stacks.

2. The method according to claim 1, wherein said pre-processing of the printed sheets further includes trimming of sheet edges of each printed sheet, which sheet edges are parallel to the slits.

3. The method according to claim 2, wherein said processing of the sheet stacks further includes trimming of sheet edges of each pre-processed printed sheet within the sheet stacks, which sheet edges are parallel to the cutting lines.

4. The method according to claim 1, wherein said processing of the sheet stacks further includes trimming of sheet edges of each pre-processed printed sheet within the sheet stacks, which sheet edges are parallel to the cutting lines.

5. The method according to claim 1, further comprising the step of inspecting and/or sorting the individual documents.

6. The method according to claim 1, further comprising the step of providing at least one alphanumeric number or coding onto at least part or all of the individual documents after processing of the sheet stacks or onto at least part or all of the imprints of at least some of said printed sheets prior to pre-processing of the printed sheets.

7. The method according to claim 1, further comprising the step of bundling said individual documents to form individual bundles.

8. The method according to claim 7, further comprising the step of providing at least one securing band around said individual bundles.

9. The method according to claim 1, wherein slitting is carried out using a laser cutting unit or a rotary knife system.

10. The method according to claim 1, wherein said printed sheets are sheets of printed securities.

11. The method according to claim 1, wherein said individual documents are banknotes.

12. A system for processing printed sheets into individual documents, each printed sheet comprising an area that is printed with an array of imprints arranged in a matrix of rows and columns, said system comprising:

a slitting unit for pre-processing said printed sheets by partly slitting each printed sheet row-wise or column-wise to form slits between adjacent rows or adjacent columns of imprints, slitting being performed in such a manner that said adjacent rows or adjacent columns of imprints are still attached to one another at edged of each thus pre-processed printed sheet, each slit running continuously from one end to another of the area printed with the array of imprints and stopping in margins of the printed sheet;

a stacking unit for stacking said pre-processed printed sheets so as to form sheet stacks comprising a predetermined number of pre-processed printed sheets stacked one upon the other; and a cutting unit for processing said sheet stacks by cutting each sheet stack column-wise or row-wise along cutting lines between adjacent columns or rows of imprints, cutting being performed along a direction perpendicular to the direction of the slits and in such a manner that individual documents are produced as a result, wherein said printed sheets exhibit at least one security element which extends row-wise or column-wise over or into said printed sheets and wherein said slitting unit is designed to perform slitting of the printed sheets along a direction parallel to said security element, wherein said security element is such that it impacts on an overall waviness of sheet piles or stacks when said printed sheets are piled or stacked one upon the other, and wherein said stacking unit is designed to perform piling of the pre-processed printed sheets in a staggered manner along a direction perpendicular to the direction of said slits so as to minimize the impact of the security element on the overall waviness of the resulting sheet piles or stacks.

13. The system according to claim 12, wherein said slitting unit is further adapted to trim sheet edges of each printed sheet, which sheet edges are parallel to the slits.

14. The system according to claim 12, wherein said cutting unit is further adapted to trim sheet edges of each pre-processed printed sheet within the sheet stacks, which sheet edges are parallel to the cutting lines.

15. The system according to claim 12, further comprising an inspecting and/or sorting unit for inspecting and/or sorting the individual documents.

16. The system according to any claim 12, further comprising a numbering unit for providing at least one alphanumeric number or coding onto at least part or all of the individual documents after processing of the sheet stacks by the cutting unit or onto at least part or all of the imprints of at least some of said printed sheets prior to pre-processing of the printed sheets by the slitting unit.

17. The system according to claim 12, wherein said slitting unit includes a laser cutting unit or a rotary knife system for slitting the printed sheets.

18. A method of processing printed sheets, into individual documents, each printed sheet comprising an area that is printed with an array of imprints arranged in a matrix of rows and columns, said method comprising the following steps:

pre-processing said printed sheets by partly slitting each printed sheet row-wise or column-wise to form slits between adjacent rows or adjacent columns of imprints, slitting being performed in such a manner that said adjacent rows or adjacent columns of imprints are still attached to one another at edges of each thus pre-processed printed sheet, each slit running continuously from one end to another of the area printed with the array of imprints and stopping in margins of the printed sheet;

stacking the pre-processed printed sheets so as to form sheet stacks comprising a predetermined number of pre-processed printed sheets stacked one upon the other; and processing said sheet stacks by cutting each sheet stack column-wise or row-wise along cutting lines between adjacent columns or rows of imprints, cutting being performed along a direction perpendicular to the direction of the slits and in such a manner that individual documents are produced as a result, wherein said printed sheets exhibit at least one security element which extends row-wise or column-wise over or into said printed sheets and wherein slitting of the printed sheets is performed along a direction parallel to said security element, wherein said security element is a security thread.

* * * * *